United States Patent [19]

Wilson, Jr.

[11] 4,084,744

[45] Apr. 18, 1978

[54] FIRE DAMPER

[75] Inventor: Charles Edwin Wilson, Jr., 2473 Cecilia Dr., Villa Hills, Ky. 41016

[73] Assignee: Charles Edwin Wilson, Jr., Cincinnati, Ohio

[21] Appl. No.: 683,494

[22] Filed: May 5, 1976

[51] Int. Cl.[2] ..... F24F 7/00; F23L 17/02

[52] U.S. Cl. ..... 236/49; 98/1; 126/285.5; 55/104

[58] Field of Search ..... 98/1, 86; 236/49; 49/2, 49/31; 169/48, 49; 251/67, 68, 69, 72, 74; 137/457, 468; 110/163; 126/285.5, 285 R; 55/104, 106, 217, 274, 270, 418

[56] References Cited

U.S. PATENT DOCUMENTS

| | | | |
|---|---|---|---|
| 1,781,026 | 11/1930 | Mapes | 49/1 X |
| 1,865,641 | 7/1932 | Persons | 126/285.5 X |
| 3,172,347 | 3/1965 | Johnson | 98/1 |
| 3,739,707 | 6/1973 | Knapp | 236/49 X |
| 3,805,884 | 4/1974 | Burt et al. | 110/163 X |

*Primary Examiner*—William E. Wayner
*Assistant Examiner*—Larry Jones
*Attorney, Agent, or Firm*—Melville, Strasser, Foster & Hoffman

[57] ABSTRACT

The fire damper of this invention is to protect sensitive areas and equipment from fires which originate in the process of a plant. The invention, for example, may have utility in the protection of bag house filters and the like. It will, however, by way of example only, be largely described herein as applied to an electrostatic air cleaner located on a process stack. In recent years such electronic air cleaners, often in the form of a two-stage electrostatic precipitator, have become quite popular. Such apparatus, however, is quite sensitive to high temperatures such as are occasioned by fires and may readily be destroyed when exposed to them. In this invention a temperature rise is sensed by means of electrical detectors and relayed to the control box of the fire damper. Here it is translated into a control signal which actuates mechanism which will withdraw a latch means which supports a vent door whereafter such door falls by means of gravity to block the duct leading to the air cleaner while at the same time venting the plant process air and fire to outside atmosphere. The mechanism which actuates the latch means such as by pulling a steel shaft or pin may be either electrical or pneumatic. A satisfactory electrical mechanism is an electric solenoid that moves the latch or pin release. A satisfactory pneumatic release is one which operates by means of a pressurized gas, preferably a dry and inert gas like nitrogen where there is no risk of freezing or flamability, to operate a pneumatic cylinder-piston arrangement to withdraw the pin which supports the vent door. The vent door is so located and pivoted that, when the latch pin is pulled, it will immediately swiftly move into fire damping position by means of gravity. Fire and heat are then simultaneously vented vertically to atmosphere through that opening in the fire damper thus uncovered by the door in moving to its fire damping position, by virtue of which any possible flashback into the process, due to the failure of a relief damper or the like to open when the duct fire damper door is closed, is prevented.

5 Claims, 12 Drawing Figures

FIRE DAMPER

BACKGROUND OF THE INVENTION

1. Field of the Invention

The fire damper which is the subject of this invention is particularly useful in conjunction with an electrostatic precipitator. Such precipitators are useful in cleaning air in industrial applications prior to returning it to the atmosphere. Such electronic air cleaners have particular application in the removal of very fine, particles in the neighborhood of 1 micron and below, although such units will handle virtually any airborne particles existing in the air stream being treated. Such a precipitator will provide a clean atmosphere while at the same time, in some instances, effecting recovery of materials which may be recycled.

The electrostatic precipitators for which the fire damper of this invention has been specifically designed are quite sensitive to elevated temperatures and fire and may readily be destroyed when exposed to them. In view of the fact that such precipitators are fairly expensive, it is desirable to protect them from exposure to elevated temperatures and fire. This is something which must be done quickly and positively. The precipitators are located so as to receive air issuing from the process area of a plant so at to clean same before discharging it to atmosphere or recirculating it. Merely to block the process air from the precipitator in time of elevated temperatures as caused by fire, however, is really not enough; not only should the air be diverted from the precipitator in times of fire and the like, but also it should be so directed as to prevent any possible flashback into the process.

2. Description of the Prior Art

Prior means to protect electrostatic precipitators and the like from fire and elevated temperatures have been varied. In some instances nothing was provided. One of the earlier protecting means included an arrangement for flooding the precipitator with water. Another arrangement involved the use of two groups of shutter-like members of the "venetian blind" type, motorized, one group to block the flow of process air to the precipitator and another group to divert such air elsewhere. Some of the prior art arrangements utilized fusable links which, upon actuation, would permit a spring to pull shut a door in the path of air moving towards the precipitator. Fuses and the like, however, often act too slowly and mechanical means such as springs and the like sometimes fail to work at all or also act too slowly. An object of the invention, therefore, is to eliminate as much as possible in the way of mechanical means between the sensing of the emergency condition and actuation of the damper.

As indicated, electrostatic precipitators to which the fire damper of this invention may be employed, are known in the art. An ionizer may be utilized to produce an electrostatic field so as to charge the particles exposed to it. These charged particles are then passed through a collecting cell comprised of charged and grounded plates so as to pick up the charged particles or contaminants.

No search of the United States Patent art has been conducted in conjunction with the fire damper of this invention nor are there any patents known as directed to, for example, the types of control units above indicated as being a part of the prior art. This is not to say, however, that there are no such patents.

There are a number of United States patents known as relating to electronic air cleaners. Some of these are as follows:

U.S. Pat. Nos. 1,697,316—HORNY:1,758,404—LABBE:2,347,709—PENNEY:
2,470,356—MACKENZIE:2,476,248—MACKENZIE:2,490,979—PALMER:
2,535,696—RICHARDSON:2,542,262—RICHARDSON:2,642,952—LANDGRAF:
2,667,941—EKSTROM:2,789,656—RICHARDSON:2,869,678—ROBERTS:
3,540,191—HERMAN:3,581,470—AITKENHEAD:3,605,915—GATELY:
3,707,828—BURNEY:3,778,970—SWIMMER: and 3,788,041—GAYLORD.

It is known that there are a number of other United States Patents relating to electronic air cleaners and, as indicated above, it is probable that there are United States Letters Patents directed to means for protecting them from elevated temperatures and fire, although patents specific to such protecting devices are not included above because not specifically known. No assertion is made, therefore, that the patents which are listed are indeed representative of the best art in this area, let alone representative of the best art known to the fire damper as such.

SUMMARY OF THE INVENTION

The fire damper is located in the path of air and the like being moved from a first area to a second area. Typically the first area may be the process section of an industrial plant and the second area may contain sensitive mechanisms such as, by way of example only, electronic air cleaners. In a typical example the damper may have one end normally in communication with duct work leading to the second area and a top which may be exposed to atmosphere but which is normally closed by the fire damper door. The door is relatively heavy and pivotally located in the damper, latch means holding it in that position which prevents air being ducted from the first area escaping to atmosphere while permitting such air to be ducted to the second area. A temperature rise in the first area is sensed by means of electrical detectors and relayed to the control box of the fire damper. Here it is translated into a control signal which actuates a mechanism to release the latch means so as to permit the door to fall by gravity so as simultaneously to block the duct leading to the second area and to open the damper to atmosphere for escape of the air being ducted from the first area. The latch release mechanism may be operated either electrically or pneumatically. In the electrical arrangement a solenoid is used that actually moves the latch release. In the pneumatic arrangement a valve opens which permits high pressure gas, preferably a dry gas like nitrogen which does not freeze or inflame, to operate a pneumatic cylinder-piston which actuates the latch release. In either arrangement, when the latch means is actuated the door falls by gravity and blocks the duct leading to the second area while simultaneously venting the fire and heated air from the first area vertically through that opening in the damper thus uncovered by the door when so released. This latter feature prevents any possible flashback into the first area as might otherwise occur if additional means were relied upon to open when the duct to the second area was closed.

BRIEF DESCRIPTION OF THE DRAWING

FIG. 2 is a perspective view of the fire damper with the fire door in its normal open position wherein air may flow from the process area to the electronic air cleaner.

FIGS. 10, 11 and 12 are typical electrical diagrams illustrating how circuits for the latch release means and warning signal may be arranged.

DESCRIPTION OF THE PREFERRED EMBODIMENTS

Figures 1, 2A, 2B, 3:
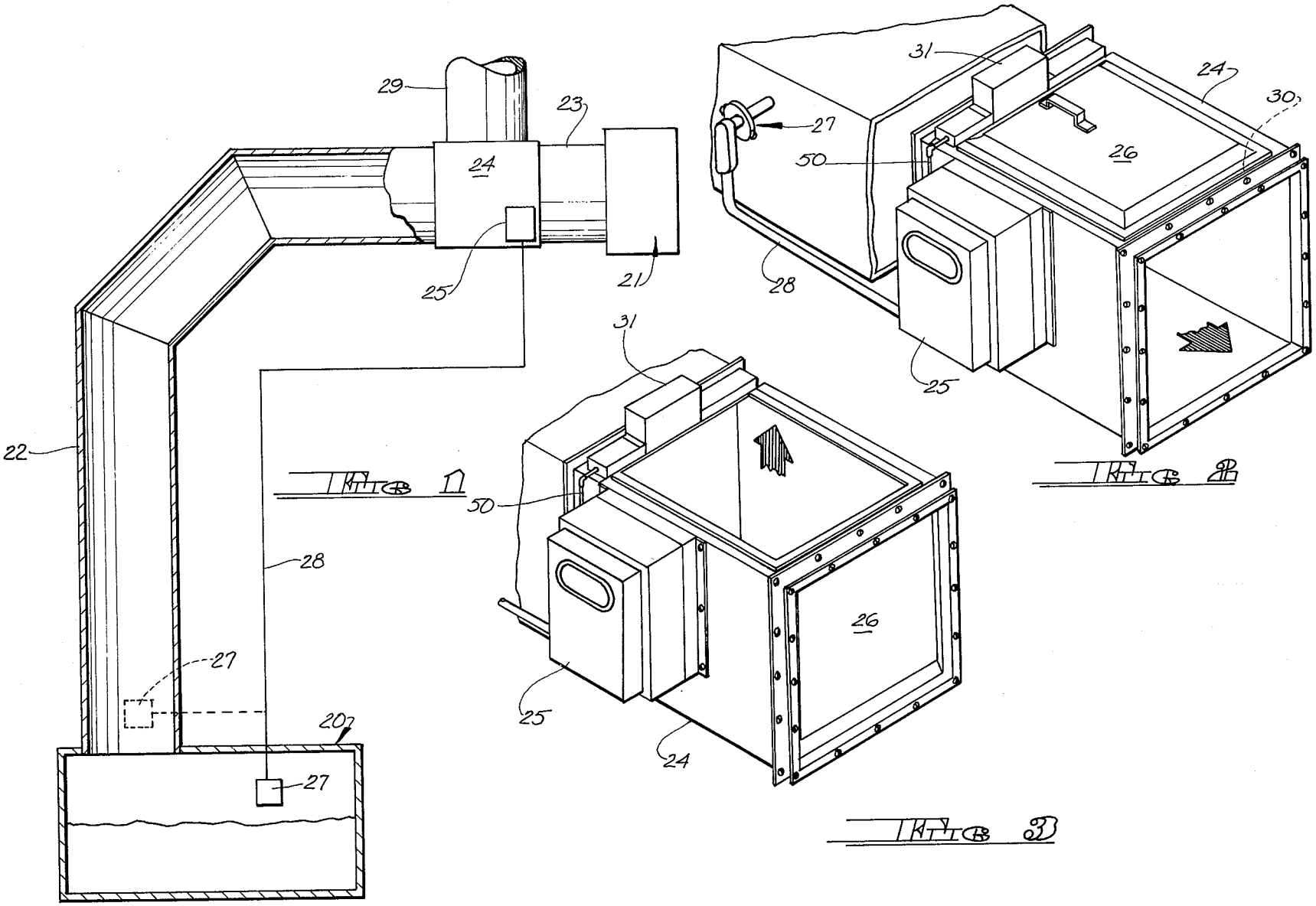
FIG. 1 is a schematic diagram depicting the invention as incorporated in duct work leading from the process area of an industrial plant to an electronic air cleaner.
FIG. 3 is a perspective view of the fire damper depicting the position of the fire door after the latch means has been released whereby the door blocks the passage of air from the process area to the electronic air cleaner while at the same time providing an opening for the escape of such air to atmosphere.

FIG. 1 depicts, by way of example, a first area generally indicated at 20 and a second area generally indicated at 21, these areas being connected by suitable duct work 22 and 23. The fire damper of this invention is generally indicated at 24 and is depicted as being inserted between the duct work 22 and 23. It will be understood that conditions within the area 20 may result in fire and elevated temperatures which normally would reach the second area 21 in which sensitive equipment to be protected is located. The fire damper 24 is provided with a control box 25 having means to permit movement by gravity of the fire door 26 from the position of FIG. 2 to that of FIG. 3 in response to elevated temperatures sensed by the means 27 located within the first area 20 and suitably connected to the control mechanism within the box 25 by the circuit diagrammatically illustrated at 28.

For purposes of illustration the first area 20 may be considered as the process area of an industrial plant and the second area 21 may be considered as an electronic air cleaner such as an electrostatic precipitator. The duct work 22, 23 normally provides for the passing of air from the process area 20 to the electronic air cleaner 21 so that such air may be cleaned and either discharged to atmosphere or recirculated within the plant as is well known in the art; contaminants precipitated by the cleaner 21 may be either discharged or recycled. The fire damper 24 is located in the duct work 22, 23 and the door 26 is normally in the position illustrated in FIG. 2 so that air may be passed from the process area 20 to the cleaner 21 for the removal of contaminants and the like. This normal flow of air through the fire damper 24 is illustrated by the arrow in FIG. 2. When the sensor 27 in the process area 20 detects elevated temperatures the mechanisms within the control box 25 are effective to actuate a latch mechanism so as to release the door 26 and permit it to fall by gravity to the position indicated in FIG. 3. In this latter position of the door 26 air from the process area 20 and fire damper 24 may no longer pass to the cleaner 21. When the door 26, however, moves to its FIG. 3 position the upper side of the fire damper as seen in FIG. 3 to open to atmosphere and the air may leave the fire damper 26 as indicated by the arrow in that FIGURE. In a typical installation the fire damper 24 may rest on the roof of the building housing the process area 20 and when the door is in the FIG. 3 position the heated air from the process area 20 and duct 22 will simply pass to atmosphere. Although a stack 29 has been illustrated in FIG. 1, this is not necessary when the damper 24 is located on the roof. If the damper 24, however, is located within the building then the stack 29 would be necessary in order to permit the fire and heated gases from the process area 20 and duct 22 to escape to atmosphere.

Figure 9:
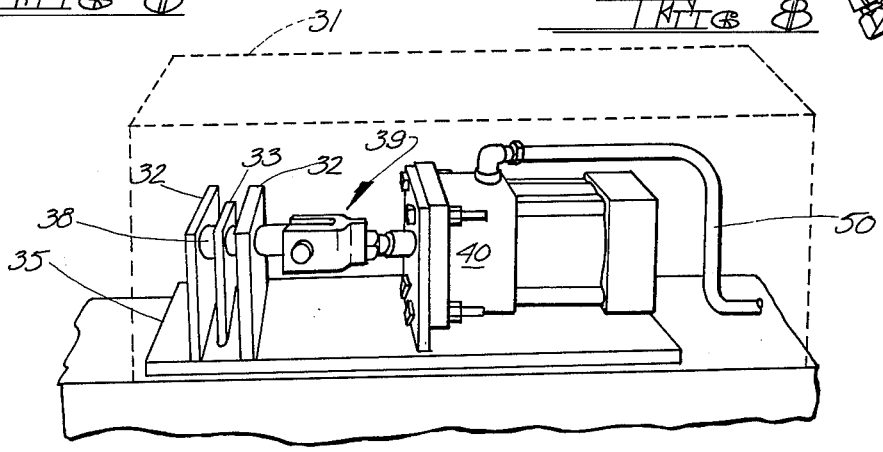
FIG. 9 is an enlarged fragmentary perspective view of the latch mechanism for the fire door and of the means to release same.

The door 26 of the fire damper 24 is pivotally connected to the fire damper at the top thereof adjacent the duct 23 leading to the cleaner 21 as is generally indicated at 30. Latch means for holding the door 26 in the FIG. 2 position is housed within the cover 31 shown in FIGS. 2 and 3 and in phantom in FIG. 9. The latch mechanism includes a pair of plates 32 fixed to the fire damper frame. The door 26 has a latch 33 which extends through an opening 34 in the frame 35. The plates 32 and latch 33 have aligned holes 36 and 37 to receive a latch pin 38 to hold the door 26 in its normal FIG. 2 position. Linkage 39 connects the latch pin 38 to suitable means generally indicated at 40 for effecting withdrawal of the pin 38 from the orifice 37 in the latch pin 33 so as to permit the door 26 to fall by gravity from the FIG. 2 position to the FIG. 3 position.

In the embodiments illustrated in FIGS. 4 through 9 the means 40 for actuating the linkage 39 and pin 38 are pneumatic. It will be understood, however, that the linkage 39 could be electrical with an electric solenoid 70 that would actually withdraw the pin 38 from the latch orifice 37 in response to a signal from the sensor 27 (see FIG. 12). By way of principal illustration, however, a pneumatic system is illustrated, one in which nitrogen is preferably the gas employed.

Figure 6:
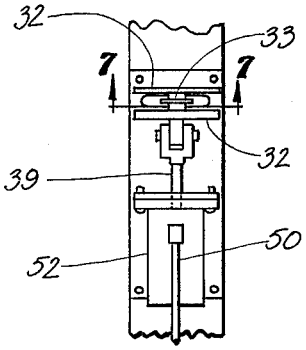
FIG. 6 is a section taken on the line 6—6 of FIG. 5 from a position just inside the latch cover.
Figure 7:
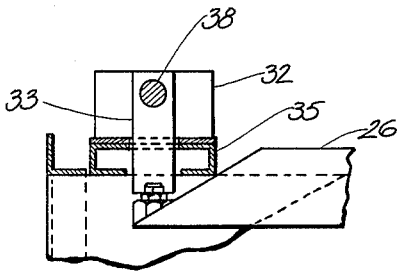
FIG. 7 is a section taken on the line 7—7 of FIG. 6.
Figure 8:
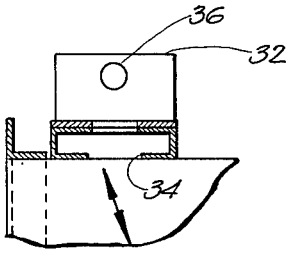
FIG. 8 is a fragmentary perspective view, partly in section, illustrating the fire door as it may move when the latch means is released.
Figure 8:
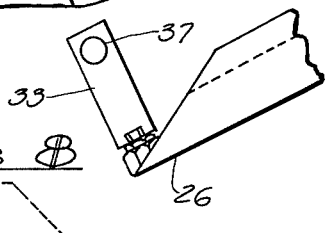

The control box or enclosure 25 houses a nitrogen bottle 41 connected through a regulator and gauge assembly 42, tees 44, nipples 45, vent valve 48 and the solenoid valve 49 to the nitrogen line 50 for the latch actuating mechanism 40. A low pressure alarm switch mechanism 51 may also be employed. Pressurized nitrogen, in response to the sensor 27 through the electrical conduits 28, flows from the bottle 41 and related mechanisms to the line 50 to actuate a piston-cylinder arrangement 52 (see FIG. 6) within the means 40. The linkage 39 is connected to the cylinder system and actuation of the piston by high pressure nitrogen will cause the latch pin 38 to be withdrawn from the aligned orifices in the plate 32 and latch 33 so as to permit the door to fall by gravity from the FIG. 2 position to the FIG. 3 position. As best seen in FIG. 6 the latch plate 32 from which the pin 33 is withdrawn is relatively thin, as so also is the latch member 33, as compared to the other plate 32, so that movement of the pin 38 out of engagement with the latch 33 is quickly and easily accomplished. The relatively thick latch plate 32 gives stability to the mechanisms.

Figure 4:
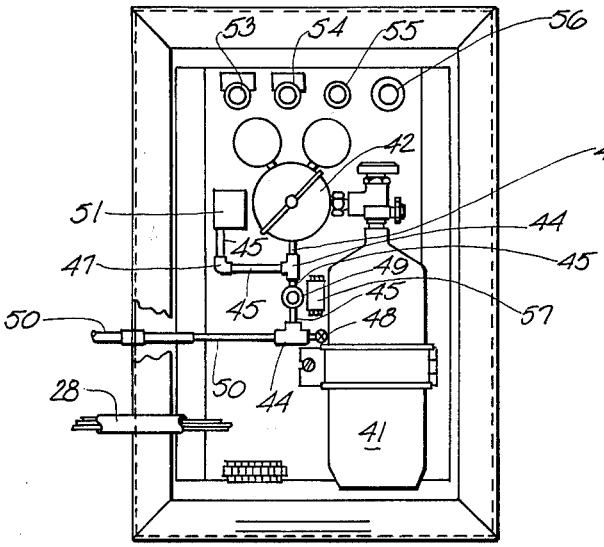
FIG. 4 is a front elevation of the open control box for the fire damper.
Figure 5:
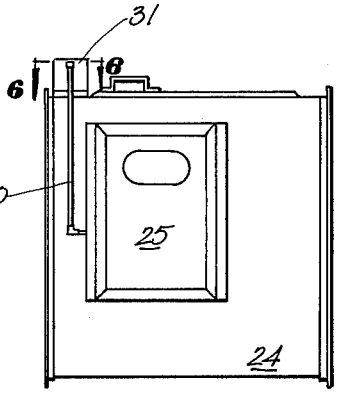
FIG. 5 is a side elevation of the fire damper and control box.
Figure 10:
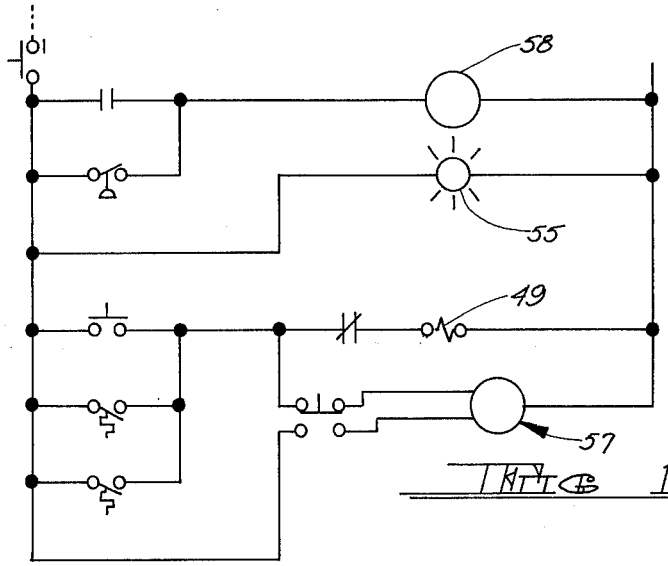
Figure 10A:
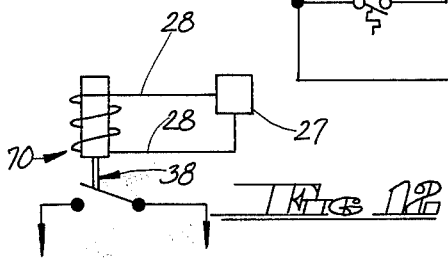
Figure 11:
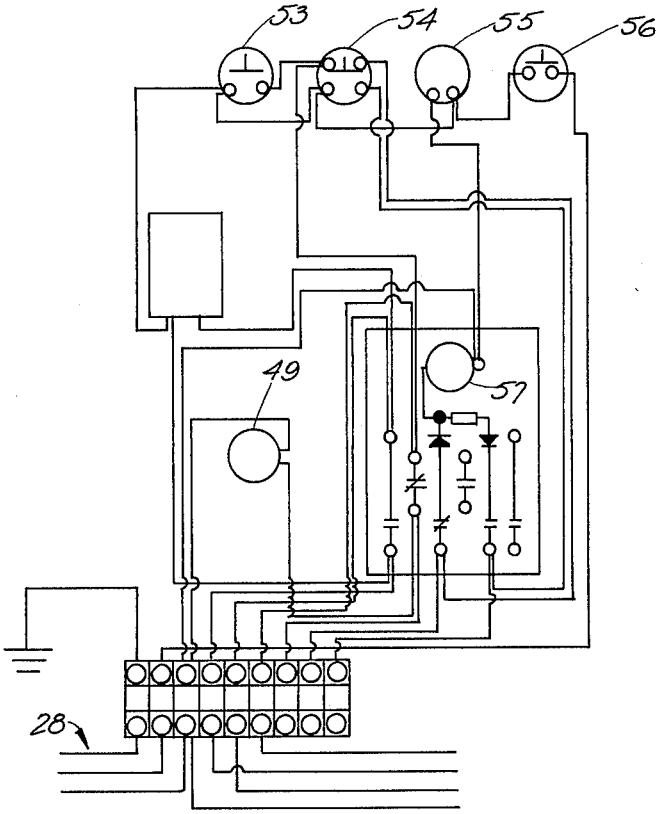

As described above the fire damper door 26 is released by means of a high pressure nitrogen bottle 41. The tank (bottle 41) is rated to be filled at 2000 psi and preferably nitrogen should be used. Under no condition should any flammable gas ever be used to pressurize the system. After the bottle has been charged it should be placed within the control box 25 as illustrated in FIG. 4 and connected to the gas system generally indicated at 42–49. The adjustment on the regulator should be set for a pressure of 150 lbs.; the pressure on the system should not exceed 175 lbs or the maximum safe rating of the piston-cylinder employed. The control box 25 also houses a test switch 53, a reset switch 54, a light 55 and a push-pull switch 56 for power to the unit; this is shown in FIGS. 4, 10 and 11. As will be understood by those skilled in the art, the system may be first tested by actuating the switch 53 whereupon the solenoid valve 49 within the control box 25 will be actuated and the door 26 released. A timer included in the timing relay 57 turns off the solenoid valve 49 within three seconds. The timer must then be reset by pushing the reset switch 54. The reset switch 54 also turns off the alarm bell 58 which should be placed in a convenient place within the building, in easy hearing range.

It will be further understood by those skilled in the art that the alarm bell 58 will be activated at any time the system is activated. During testing the alarm bell will also be activated at any time the system is activated. Such activation of the alarm will continue until the system is properly reset. It is also a feature of this invention that the alarm bell 58 is so incorporated into the system that it will be activated when the pressure in the system drops below 100 psi. signaling that the nitrogen bottle must be refilled. The reset button 54 turns off the alarm bell and is so incorporated into the system that such will not be reactivated until the reset switch has been pushed. To vent the cylinder-piston arrangement 52 in order to reset the door, gas in the cylinder should first be allowed to escape through vent valve 48. It will be apparent from the foregoing that the release circuit can be tested and used may times without destroying any part of the system.

It should be emphasized that the fire damper 24 makes use of the weight of the door 26 to move same into position by reason of its pivotal mounting at one edge as indicated at 30 in FIG. 2. Note also that the activating device within the control box 25 incorporates a fast acting electrical sensor 27 coupled with a mechanical release, pneumatically or electrically operated as described herein, that is located out of the process air stream and weather protected by enclosure within the housing 31. And as noted, the damper function of the door 26 is coupled with warning indicators that show if the damper is properly set and processed.

It is preferable that the fire damper 24, when used with an electrostatic precipitator such as may be generally indicated at 21, should be installed in the duct work 22, 23 as close to the cleaner 21 as possible. It should be installed in such a position that the vent door 26 is on the top of the damper 24, and that when it is dropped, it blocks the duct work 23 leading to the cleaner 21, thus forcing any fire coming through the duct 22 to be vented upwardly. The fire damper 24 may be located on the roof whereby the fire and elevated temperatures from the duct 22 will simply go out the top of the damper 24 into atmosphere; as indicated, however, the fire damper 24 may be located within the building and a stack 29 be utilized to lead the fire and hot gases from the damper 24 to atmosphere. Also, the sensor 27 should be placed in the process area 20 as close to the duct work 22 as possible. In some instances, therefore, it might be possible to locate the sensor 27 in the dotted line position of FIG. 1. Preferably the electrical sensor should be approximately 100° fahrenheit above the average process temperature. This differential is preferred in order to prevent accidental operation of the fire damper. It will be apparent to those skilled in the art that all wiring should be placed in weather proof conduit leading to the control box.

The arrangement of the door 26 and any gasket material utilized to seal the unit should be so adjusted that the door will fall by gravity when the latch mechanism is actuated so that it will drop unobstructed.

It will be apparent to those skilled in the art that modifications may be made in this invention without departing from the scope and spirit thereof. Note for example, the electrically actuated solenoid 70 for effecting movement of the latch pin 38. It will also be apparent that while some of the illustrations depicting the invention are schematic and diagrammatic, such as the arrangements of FIGS. 1, 10 and 11, nevertheless those skilled in the art will readily perceive how the invention operates. Thus it is to be further understood that while the invention has been shown as incorporated in particular structures and arrangements, the invention is not to be limited to such structures and arrangements excepting insofar as they are specifically set forth in the subjoined claims.

Having thus described the invention what is claimed as new and what is desired to be protected by Letters Patent is:

1. A fire damper comprising a housing having a first side open to receive gases from a first area, a second side normally open to permit said gases to flow to a second area, and a third side normally closed; a door pivotally connected to said housing in a first position so as normally to effect the closing of said third side while said first and said second sides are open, said door being swingable by gravity to a second position in which said normally open second side is closed by said door and in which said normally closed third side is open so as to permit said gases to flow from said housing through said third side only; releasable latch means to normally maintain said door in said first position; and heat sensitive means to actuate said releasable latch means in response to temperature changes in said first area whereby to permit said door to swing from said first position to said second position, said heat sensitive means including pneumatic means to actuate said latch means, and a heat sensor in the region of said first area, said heat sensor being electrically connected to said pneumatic means, whereby said releasable latch means are actuated in response to a temperature increase in said first area.

2. A fire damper comprising a housing having a first side open to receive gases from a first area, a second side normally open to permit said gases to flow to a second area, and a third side normally closed; a door pivotally connected to said housing in a first position so as normally to effect the closing of said third side while said first and said second sides are open, said door being swingable by gravity to a second position in which said normally open second side is closed by said door and in which said normally closed third side is open so as to permit said gases to flow from said housing through said third side only; releasable latch means to normally maintain said door in said first position; and heat sensitive means to actuate said releasable latch means in response to temperature changes in said first area whereby to permit said door to swing from said first position to said second position; said heat sensitive means including an electric solenoid to actuate said latch means, and a heat sensor in the region of said first area, said heat sensor being electrically connected to said electric solenoid, whereby said releasable latch means are actuated in response to a temperature increase in said first area.

3. A fire damper adapted to be placed in duct work for normally leading air from a first area to a second area of a building and the like, which fire damper comprises: a main housing; a door pivoted in said main housing, said door having a first position in which one side of said housing is open to said first and second areas while an other side of said housing is closed; latch means to hold said door in said first position; and heat sensitive means to actuate said latch means in response to temperature changes in said first area so that said door moves by gravity from said first position to a second position in which said one side of said housing is closed and said other side of said housing is opened; said latch means comprising a latch member on said door, a latch plate on said main housing, aligned orifices in said latch member and said latch plate when said door is in its said first position, and a pin extending through said orifices to hold said door in said first position until such time as said latch means is actuated whereby said pin is withdrawn from said orifices and said door moves by gravity from said first position to said second position; whereby when said first damper is in said duct work and said one side is in communication with both said first and second areas, actuation of said door to said second position will cut off flow of air to said second area and open said fire damper to flow of air from said first area and out of said fire damper.

4. The fire damper of claim 3 including a pneumatic piston-cylinder means, said pin being connected to said piston-cylinder means, a source of pressurized fluid for said piston-cylinder means, said piston-cylinder means normally maintaing said pin in said alligned orifices, the said means to actuate said latch means including a control device for permitting pressurized fluid to enter said piston-cylinder means and actuate same to withdraw said pin from said orifices.

5. The fire damper of claim 4 in which said fluid is nitrogen.

* * * * *

UNITED STATES PATENT AND TRADEMARK OFFICE

CERTIFICATE OF CORRECTION

PATENT NO. : 4,084,744

DATED : April 18, 1978

INVENTOR(S) : Charles Edwin Wilson, Jr.

It is certified that error appears in the above-identified patent and that said Letters Patent are hereby corrected as shown below:

On the front page, adjacent "assignee" delete the assignee's name therein noted, namely "Charles Edwin Wilson, Jr., Cincinnati, Ohio", and substitute therefor the true assignee's name -- United Air Specialists, Inc., Cincinnati, Ohio --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*